US008933358B2

(12) United States Patent
Yang

(10) Patent No.: US 8,933,358 B2
(45) Date of Patent: Jan. 13, 2015

(54) POWER TRANSMISSION DEVICE FOR VACUUM INTERRUPTER AND VACUUM BREAKER HAVING THE SAME

(75) Inventor: Jae Min Yang, Cheongju-Si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 284 days.

(21) Appl. No.: 13/550,429

(22) Filed: Jul. 16, 2012

(65) Prior Publication Data

US 2013/0026020 A1 Jan. 31, 2013

(30) Foreign Application Priority Data

Jul. 25, 2011 (KR) ..... 10-2011-0073803

(51) Int. Cl.

| | |
|---|---|
| ***H01H 33/666*** | (2006.01) |
| ***H01H 33/42*** | (2006.01) |
| ***H01H 3/48*** | (2006.01) |
| *H01H 3/32* | (2006.01) |
| *H01H 3/42* | (2006.01) |
| *H01H 3/46* | (2006.01) |

(52) U.S. Cl.

CPC ..... *H01H 33/666* (2013.01); *H01H 3/48* (2013.01); *H01H 2003/323* (2013.01); *H01H 3/42* (2013.01); *H01H 3/46* (2013.01)

USPC ..... 218/140; 218/120; 218/153

(58) Field of Classification Search

CPC . H01H 33/66; H01H 33/666; H01H 33/6661; H01H 3/32; H01H 3/42; H01H 3/54

USPC ..... 200/400, 401; 218/153, 154, 7, 14, 120, 218/140

See application file for complete search history.

(56) References Cited

U.S. PATENT DOCUMENTS 4,568,806 A * 2/1986 Frink ..... 218/57
4,591,679 A 5/1986 Yamat et al.
4,788,390 A * 11/1988 Crino ..... 218/143

(Continued)

FOREIGN PATENT DOCUMENTS

CN 1791955 6/2006
EP 2270827 1/2011

(Continued)

OTHER PUBLICATIONS

European Patent Office Application Serial No. 12176735.4, Search Report dated Feb. 27, 2014, 7 pages.

(Continued)

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

Disclosed are a power transmission device for a vacuum interrupter, and a vacuum breaker having the same. The device includes: a driving link coupled to an adjuster; a driven link coupled to a movable electrode of a vacuum interrupter; connection links configured to connect the driving link and the driven link with each other, and coupled to the driving link and the driven link such that an interval between the driving link and the driven link is varied; cams coupled to the connection links in a perpendicular direction; and cam guides having guide recesses for slidably coupling the cams, and configured to guide the interval between the driving link and the driven link to be changed.

12 Claims, 4 Drawing Sheets

(56) References Cited

U.S. PATENT DOCUMENTS

| | | | | |
|---|---|---|---|---|
| 5,561,280 | A * | 10/1996 | Blatter | 218/59 |
| 6,849,819 | B2 * | 2/2005 | Tresy et al. | 218/3 |

FOREIGN PATENT DOCUMENTS

| | | |
|---|---|---|
| JP | 9-147698 | 6/1997 |
| JP | 9-147703 | 6/1997 |
| JP | 2009-266511 | 11/2009 |
| WO | 2004-109734 | 12/2004 |

OTHER PUBLICATIONS

Japan Patent Office Application Serial No. 2012-162750, Office Action dated Aug. 6, 2013, 2 pages.

The State Intellectual Property Office of the People's Republic of China Application Serial No. 201210258691.6, Office Action dated May 26, 2014, 8 pages.

* cited by examiner

POWER TRANSMISSION DEVICE FOR VACUUM INTERRUPTER AND VACUUM BREAKER HAVING THE SAME

CROSS-REFERENCE TO RELATED APPLICATION

Pursuant to 35 U.S.C. §119(a), this application claims the benefit of earlier filing date and right of priority to Korean Application No. 10-2011-0073803, filed on Jul. 25, 2011, the contents of which is incorporated by reference herein in its entirety.

BACKGROUND OF THE INVENTION

1. Field of the Invention

The present disclosure relates to a power transmission device for a vacuum interrupter applied to a vacuum circuit breaker, and a vacuum breaker having the same.

2. Background of the Invention

Generally, a vacuum interrupter of a vacuum circuit breaker is a main extinguishing device applied to a vacuum breaker, a vacuum switching device, a vacuum connector, etc. for interrupting a load current or an accident current in a power system. The vacuum circuit breaker for controlling power transmission and protecting a power system has advantages such as a large interruption capacity, high reliability, high stability, and small installation space. Owing to such advantages the application ranges of the vacuum circuit breaker are increased. Furthermore, as industrial equipment becomes large, an interruption capacity of the circuit breaker becomes also large.

In case of an ultra high voltage vacuum interrupter, an interval between a fixed electrode and a movable electrode in a trip state is wider than that of a low voltage vacuum interrupter, and a closing speed is very rapid. Accordingly, an impact amount between the movable electrode and the fixed electrode during a closing operation is very great. Such impact may cause transformation of a fixed electrode and a movable electrode, and such transformation may lower performance of the vacuum interrupter. In order to solve such problems, if the entire closing speed is made to be slow, closing time becomes long. As a result, time for which a pre-arc occurring when a vacuum insulation state disappears during a closing operation is maintained is long. Such long duration for which pre-arc has occurred badly influences on performance of the vacuum breaker. Therefore, the entire closing time should be constantly maintained.

FIG. 1 is a sectional view of a vacuum interrupter in accordance with the conventional art.

As shown in FIG. 1, the conventional vacuum interrupter includes an insulating container 1 sealed by a fixed side flange 2 and a movable side flange 3. A fixed electrode 4 and a movable electrode 5 face each other in a contactable manner in the insulating container 1, and are accommodated in an inner shield 6 fixed to the insulating container 1. A fixed shaft 4*a* of the fixed electrode 4 is fixedly-coupled to the fixed side flange 2, thereby being connected to the outside. And, a movable shaft 5*a* of the movable electrode 5 is slidably-coupled to the movable side flange 3, thereby being connected to an adjuster (not shown) disposed outside the insulating container by links and joints. Accordingly, movement of an output unit of the adjuster is proportional to movement of the movable shaft.

A bellows shield 7 is fixedly-coupled to the movable shaft 5*a* of the movable electrode 5, and a bellows 8 is provided between the bellows shield 7 and the movable side flange 3.

Under such configuration, the movable electrode 5 and the movable shaft 5*a* are movably installed in the insulating container 1 in a sealed state.

In the conventional vacuum interrupter, in the occurrence of an accident current, the movable electrode moves, by the adjuster, towards a direction spaced from the fixed electrode. As a result, the movable electrode is separated from the fixed electrode, thereby extinguishing an accident current.

Once the accident current is extinguished, the movable electrode moves towards a closing direction by a restoration force of the adjuster, i.e., moves towards the fixed electrode at the same speed. As a result, the movable electrode comes in contact with the fixed electrode to implement a closing operation.

However, the conventional vacuum interrupter has the following problems.

Firstly, energy stored in a compression spring of the adjuster is applied to the movable electrode as it is. As a result, the movable electrode moves while maintaining the same speed during a closing operation, thereby having a significantly increased contact speed with the fixed electrode. This may increase an impact amount between the movable electrode and the fixed electrode, thereby causing damages of components of the movable electrode or the fixed electrode or the insulating container.

SUMMARY OF THE INVENTION

Therefore, an aspect of the detailed description is to provide a power transmission device for a vacuum interrupter and a vacuum breaker having the same, the power transmission device capable of reducing a collision speed between a movable electrode and a fixed electrode during a closing operation, and capable of reducing pre-arc time taken for the movable electrode to pass through a pre-arc region by rapidly moving the movable electrode, by using a speed-variable (deceleration) closing apparatus.

To achieve these and other advantages and in accordance with the purpose of this specification, as embodied and broadly described herein, there is provided a power transmission device for a vacuum interrupter, the device comprising: a driving link coupled to an adjuster for adjusting a movable electrode of a vacuum interrupter; a driven link coupled to the movable electrode of the vacuum interrupter; connection links configured to connect the driving link and the driven link with each other, and coupled to the driving link and the driven link such that an interval between the driving link and the driven link is varied as a plurality of links are foldable with respect to each other; cams coupled to the connection links in a perpendicular direction; and cam guides having guide recesses for slidably coupling the cams, and configured to guide the interval between the driving link and the driven link to be changed, by selectively folding the connection links as a path of the cams is variable.

The connection links may include a first connection link rotatably coupled to the end of the driving link; and a second connection link having one end rotatably coupled to the first connection link, and another end rotatably coupled to the end of the driven link.

The cams may be coupled to a connection part between the first connection link and the second connection link.

The guide recesses may include first recess portions formed in parallel to the movable electrode; second recess portions formed at the ends of the first recess portions of the movable electrode side, in a curved or inclined shape so as to be widened towards the movable electrode; and third recess portions formed at the ends of the second recess portions of the movable electrode side, in a curved or inclined shape towards the adjuster-side ends of the first recess portions.

Protrusions may be formed among the first, second and third recess portions such that the cams smoothly move along each recess portions.

Contact parts between the first recess portions and the second recess portions may be formed at a pre-arc start time point, or near the pre-arc start time point, the pre-arc generated between a fixed electrode and the movable electrode when the vacuum interrupter is closed.

Contact parts between the second recess portions and the third recess portions may be formed at a contact time point between the movable electrode and the fixed electrode, or at a time point after the contact time point.

A tensile elastic member may be further provided between the driving link and the driven link.

To achieve these and other advantages and in accordance with the purpose of this specification, as embodied and broadly described herein, there is also provided a vacuum breaker, comprising: an adjuster; a vacuum interrupter including a movable electrode coupled to the adjuster and performing a linear motion, and a fixed electrode from which the movable electrode is selectively detachable; and a power transmission device disposed between the adjuster and the vacuum interrupter, and configured to change an interval between the adjuster and the movable electrode.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a power transmission device for a vacuum interrupter, and a vacuum breaker having the same according to the present invention will be explained in more details with reference to the attached drawings.

Figure 1:
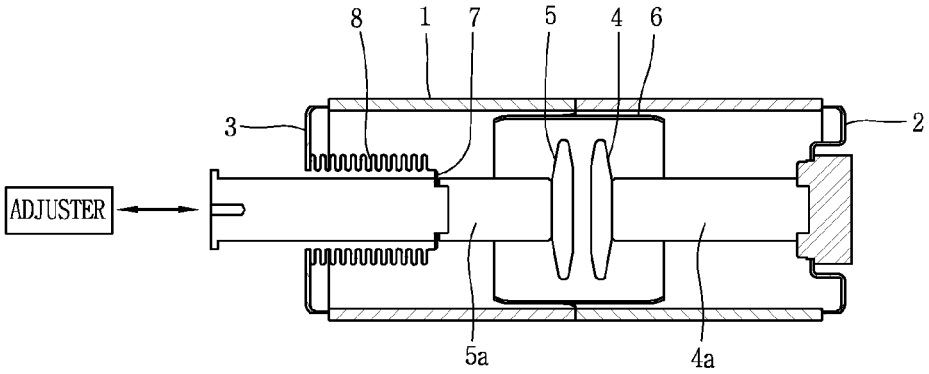
FIG. 1 CONVENTIONAL ART
FIG. 1 is a sectional view of a vacuum interrupter in accordance with the conventional art.
Figure 2:
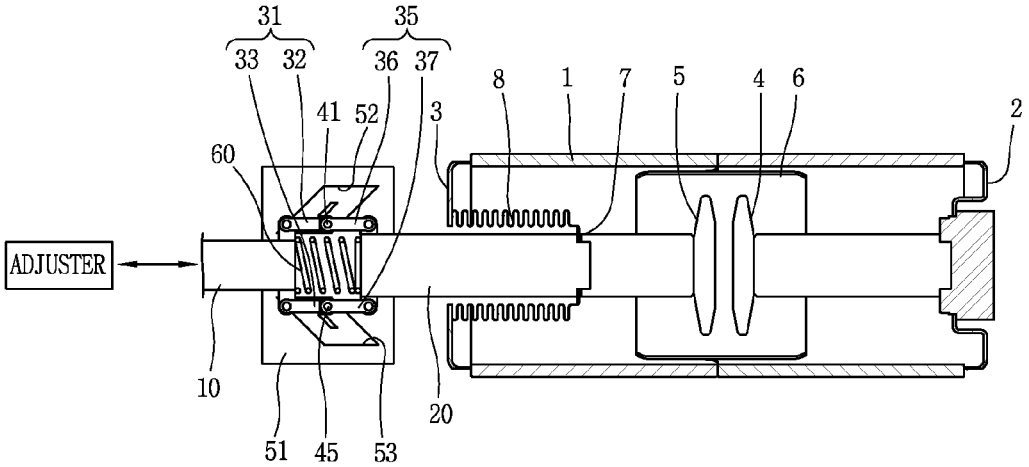
FIG. 2 is a sectional view of a vacuum interrupter and a power transmission device according to the present invention.
Figure 3:
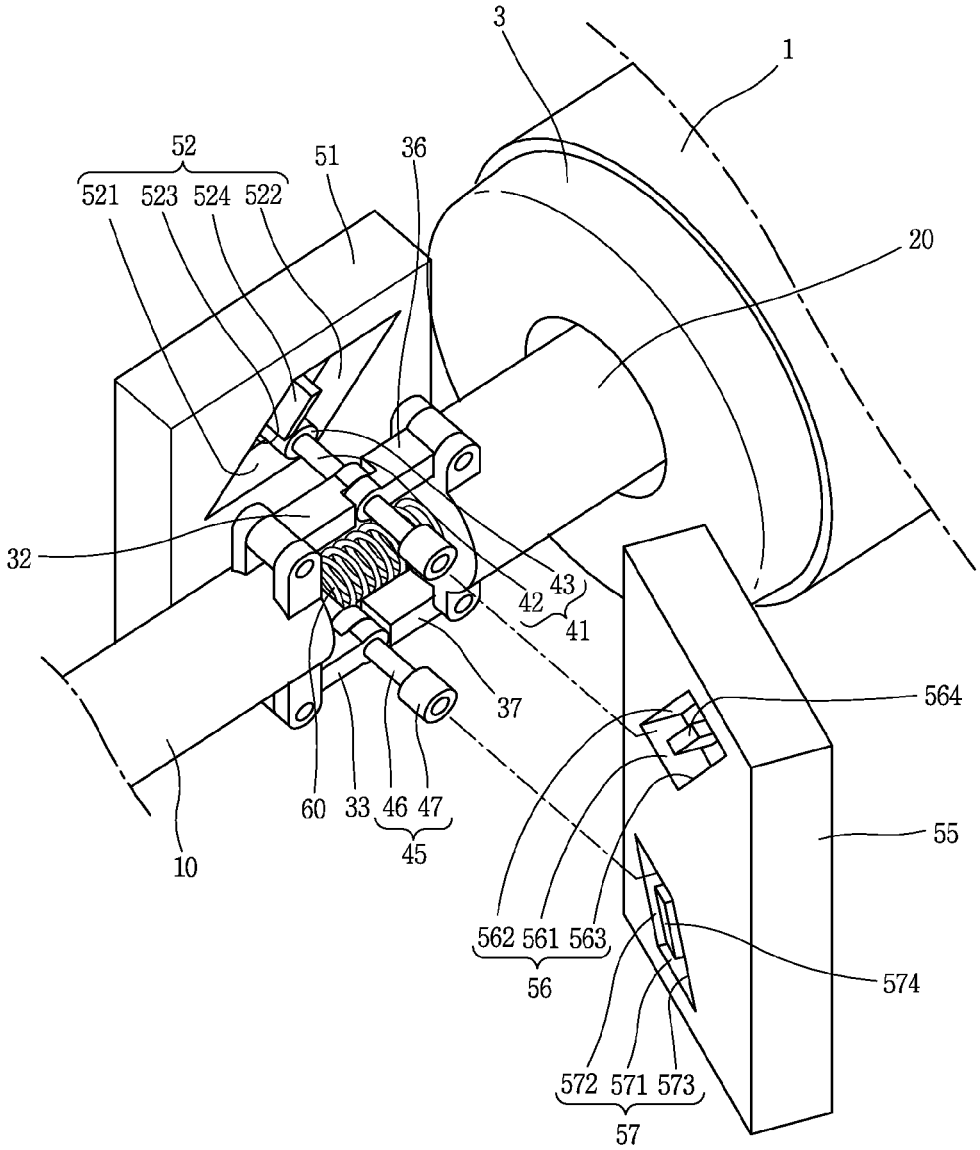
FIG. 3 is a perspective view illustrating the power transmission device of FIG. 2.
Figure 4:
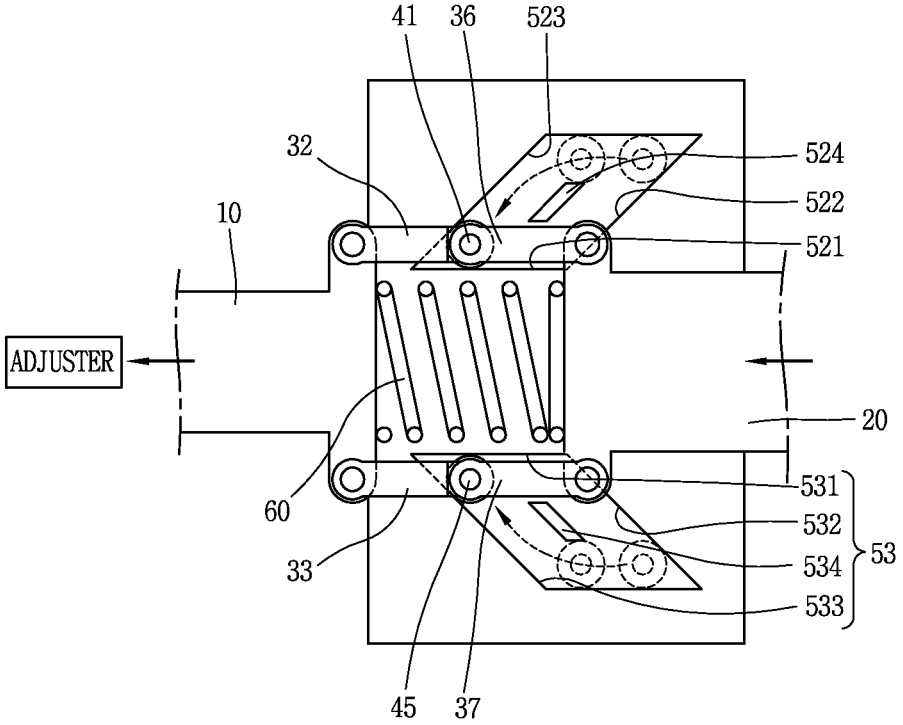
FIGS. 4 and 5 are sectional views illustrating operation states of the vacuum interrupter and the power transmission device of FIG. 2.
Figure 5:
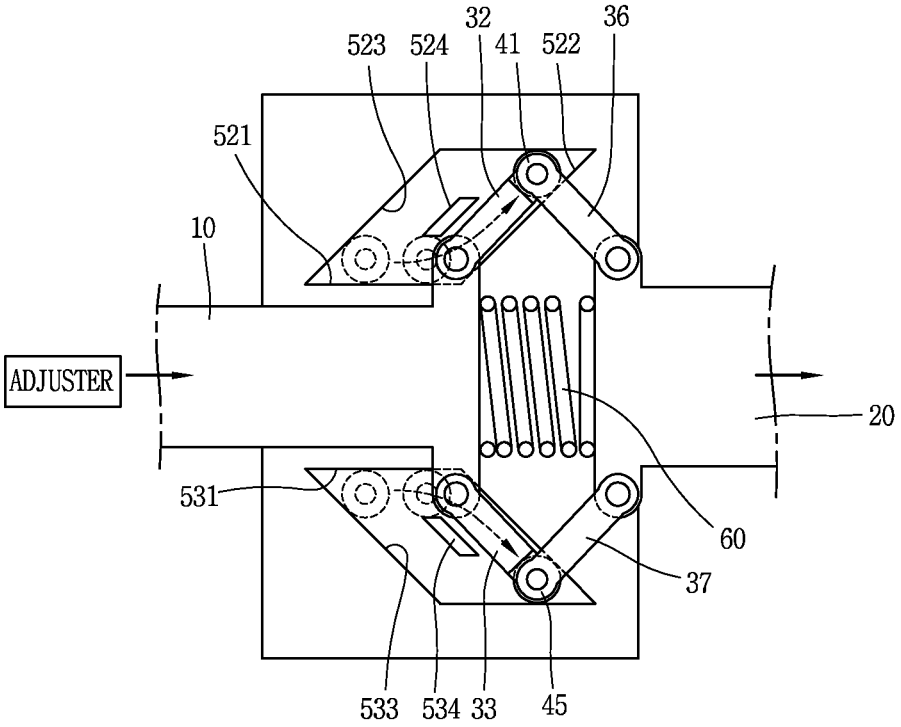

FIG. 2 is a sectional view of a vacuum interrupter and a power transmission device according to the present invention, FIG. 3 is a perspective view illustrating the power transmission device of FIG. 2, and FIGS. 4 and 5 are sectional views illustrating operation states of the vacuum interrupter and the power transmission device of FIG. 2.

As shown in FIGS. 2 and 3, the vacuum breaker according to the present invention includes a power transmission device for a vacuum interrupter (hereinafter, will be referred to as a 'power transmission device'), the power transmission device provided between an adjuster and a vacuum interrupter, and configured to change an interval between the adjuster and a movable electrode of a vacuum interrupter to be later explained, in a driving direction of the adjuster.

The power transmission device includes a driving link 10 coupled to an adjuster, a driven link 20 coupled to a movable electrode 5 of a vacuum interrupter, a first connection link 31 and a second connection link 35 configured to connect the driving link 10 and the driven link 20 to each other, a first cam 41 and a second cam 45 coupled to a connection point between the first connection link 31 and the second connection link 35 in a perpendicular direction, a first cam guide 51 and a second cam guide 55 to which the first cam 41 and the second cam 45 are slidably coupled, and an elastic member 60 coupled to a position between the driving link 10 and the driven link 20.

The driving link 10 is formed in a bar shape having a prescribed diameter. One end of the driving link 10 is coupled to a shaft portion of an adjuster (not shown), and another end of the driving link 10 is disposed on the same straight line as the shaft portion of the adjuster so as to face the driven link 20.

Like the driving link 10, the driven link 20 is formed in a bar shape having a prescribed diameter. One end of the driven link 20 is coupled to a movable electrode 5 of the vacuum interrupter, and another end of the driven link 20 is disposed on the same straight line as the movable electrode 5 so as to face the driving link 10.

The first connection link 31 includes a first upper connection link 32 and a first lower connection link 33 each rotatably coupled to another end of the driving link 10. And, the second connection link 35 includes a second upper connection link 36 and a second lower connection link 37 each having one end rotatably coupled to the first upper connection link 32 and the first lower connection link 33, respectively, and each having another end rotatably coupled to the driven link 20.

Each of the cam 41 and the second cam 45 is formed in a cylindrical bar having a prescribed diameter and length. The first cam 41 is coupled to a connection point between the first upper connection link 32 and the first lower connection link 33, and the second cam 45 is coupled to a connection point between the second upper connection link 36 and the second lower connection link 37. The first upper connection link 32, the first lower connection link 33, the second upper connection link 36 and the second lower connection link 37 are connected to each other, so as to be rotatable centering around the first cam 41. The first cam 41 includes a first cam pin 42 and a first cam roller 43, and the second cam 45 includes a second cam pin 46 and a second cam roller 47. The first cam pin 42 connects the connection links 32 and 36 to each other, and the second cam pin 46 connects the connection links 33 and 37 to each other. The first cam rollers 43 are provided at both ends of the first cam pin 42, and the second cam rollers 47 are provided at both ends of the second cam pin 46. And, the first cam rollers 43 and the second cam rollers 47 are slidably coupled to upper guide recesses 52 and 56 and lower guide recesses 53 and 57 of a first cam guide 51 and a second cam guide 55 to be later explained, respectively.

Each of the first cam guide 51 and the second cam guide 55 is formed as a plate body having a predetermined thickness, and are fixedly installed at both sides of each of the first cam 41 and the second cam 45 at prescribed intervals. The upper guide recesses 52 and 56, and the lower guide recesses 53 and 57 to which the first cam 41 and the second cam 45 are slidably inserted are formed on each one side surface of the first cam guide 51 and the second cam guide 55, i.e., facing surfaces of the first cam 41 and the second cam 45.

More specifically, the upper guide recesses 52 and 56 include first upper recess portions 521 and 561 formed in parallel to the movable electrode 5, second upper recess portions 522 and 562 curved or inclined in an intermediate direction between a radial direction and a lengthwise direction of the vacuum interrupter (widening direction towards the movable electrode), based on the ends of the first upper recess portions 521 and 561 at the vacuum interrupter side (or movable electrode side), and third upper recess portions 523 and 563 curved or inclined in a narrowing direction towards the adjuster-side ends of the first upper recess portions 521 and 561, from the ends of the second upper recess portions 522 and 562. Upper protrusions 524 and 564 are formed among the first upper recess portions 521 and 561, the second upper recess portions 522 and 562, and the third upper recess portions 523 and 563, so that the first cam 41 can smoothly move along each recess portions.

Connection points between the ends of the first upper recess portions 521 and 561 and the ends of the second upper recess portions 522 and 562 are preferably formed at a pre-arc start point, the pre-arc occurring when the vacuum interrupter is closed. For enhanced reliability, the ends of the second upper recess portions 522 and 562 and the ends of the third upper recess portions 523 and 563 are preferably formed at a contact time point between the movable electrode 5 and a fixed electrode 4, or at a time point after the contact time.

The lower guide recesses 53 and 57 include first lower recess portions 531 and 571, second lower recess portions 532 and 572, and third lower recess portions 533 and 573. And, the first lower recess portions 531 and 571, the second lower recess portions 532 and 572, and the third lower recess portions 533 and 573 are formed to be symmetrical to the first upper recess portions, the second upper recess portions, and the third upper recess portions, respectively. Lower protrusions 534 and 574 are formed among the first lower recess portions 531 and 571, the second lower recess portions 532 and 572, and the third lower recess portions 533 and 573, so that the second cam 45 can smoothly move along each recess portions.

The elastic member 60 is configured as a tensile coil spring. One end of the elastic member 60 is coupled to the end of the driving link 10, whereas another end of the elastic member 60 is coupled to the end of the driven link 20 facing the end of the driving link 10. However, the elastic member 60 is not an absolutely-required component. That is, the power transmission device for a vacuum interrupter according to the present invention can operate by the connection links, the cams and the cam guides, without the elastic member 60.

The same components of the present invention as the conventional ones are provided with the same reference numbers.

Unexplained reference numeral 1 denotes an insulating container, 2 denotes a fixed side flange, 3 denotes a movable side flange, 4 denotes a fixed electrode, 5 denotes a movable electrode, 6 denotes an inner shield, 7 denotes a bellows shield, and 8 denotes a bellows.

The power transmission device for a vacuum interrupter, and a vacuum breaker having the same according to the present invention have the following effects.

As shown in FIG. 4, if the present state of the vacuum interrupter is converted into a trip state due to an accident current, the driving link 10 is pulled by the adjuster towards the adjuster. Then, the first cam 41 and the second cam 45 coupled to the first connection link 31 and the second connection link 35 move along the third recess portions 523 and 563 of the first cam guide 51, and along the third recess portions 533 and 573 of the second cam guide 55. As a result, the first connection link 31 and the second connection link 35 become unfolded, and the driven link 20 moves along the driving link 10 towards the adjuster by the elastic member 60. Accordingly, the movable electrode 5 coupled to the driven link 20 is separated from the fixed electrode 4, thereby interrupting the vacuum circuit. Once the first cam 41 and the second cam 45 reach the adjuster-side ends of the third recess portions 523, 563, 533 and 573, the first connection link 31 and the second connection link 35 become completely unfolded. As a result, the movable contact 5 and the fixed contact 4 are separated from each other.

Next, as shown in FIG. 5, if the present state of the vacuum interrupter is converted into a closed state due to removal of an accident current, the driving link 10 is moved towards the vacuum interrupter by the adjuster. Then, the first cam 41 and the second cam 45 move along the first upper recess portions 521 and 561 of the first cam guide 51, and along the first lower recess portions 531 and 571 of the second cam guide 55. Here, the first connection link 31 and the second connection link 35 rapidly move towards the vacuum interrupter, in an unfolded state. Then, the first cam 41 and the second cam 45 move with being widened along the second upper recess portions 522 and 562 of the first cam guide 51, and the second lower recess portions 532 and 572 of the second cam guide 55. As a result, a thrust by the adjuster transmitted to the driving link 10 is absorbed by tensile forces of the cams 41 and 45, the cam guides 51 and 55, and the elastic member 60, thereby significantly decreasing a moving speed of the driven link 20. The movable electrode 5 coupled to the driven link 20 rapidly moves before a pre-arc start point, and slowly moves after the pre-arc start point. Then, the movable electrode 5 is almost stopped at a contact point between the fixed electrode 4 and the movable electrode 5.

Figure 6:
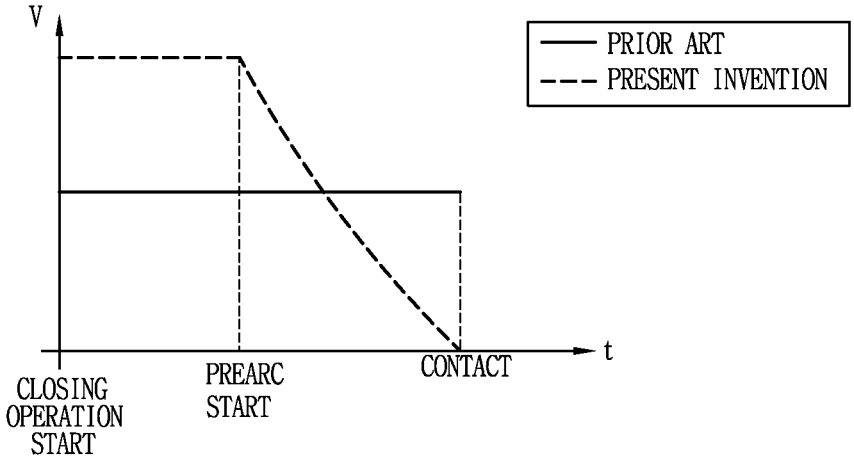
FIG. 6 is a graph illustrating a pre-arc reducing effect by a power transmission device for a vacuum interrupter according to the present invention.

Under such configuration, when the present state of the vacuum interrupter is converted into a closed state, an impact amount between the movable electrode 5 and the fixed electrode 4 can be reduced. The movable electrode 5 is rapidly closed at a closing start point, and the closing speed of the movable electrode 5 is drastically reduced from a pre-arc start point to a contact point between the movable electrode 5 and the fixed electrode 4. As a result, the entire time taken for the movable electrode 5 to pass through the pre-arc region can be more reduced than in the conventional art where the movable electrode 5 moves at the same speed. This can be seen from the graph shown in FIG. 6. That is, a closing speed at a closing start point is much faster than that of the conventional art, by a thrust of the adjuster and an elastic force of the elastic member disposed between the driving link and the driven link. Then, the closing speed of the movable electrode 5 is rapidly decreased from the pre-arc start point. And, the closing speed of the movable electrode 5 is controlled to be almost 'zero' at a contact point between the movable electrode 5 and the fixed electrode 4. In this embodiment, even if a closing speed of the movable electrode 5 is lowered at the pre-arc start point, the entire time taken for the movable electrode 5 to pass through the pre-arc region can be more reduced than in the conventional art where the movable electrode 5 moves at the same speed.

Since the interval between the adjuster and the movable electrode can be varied as a plurality of links are foldable with respect to each other between the adjuster and the movable electrode, an impact amount between the movable electrode and the fixed electrode can be reduced when the present state of the vacuum interrupter is converted into a closed state. As a result, when the movable electrode 5 is closed, the entire time taken for the movable electrode 5 to pass through the pre-arc region can be more reduced. This can prevent damages of the electrodes.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A power transmission device for a vacuum interrupter, the device comprising:

a driving link for adjusting a movable electrode of the vacuum interrupter;

a driven link coupled to the movable electrode;

a plurality of connection links configured to connect the driving link to the driven link, the plurality of connection links coupled to the driving link and the driven link such that an interval between the driving link and the driven link is varied as the plurality of links are folded with respect to each other;

cams coupled between the plurality of connection links in a perpendicular direction; and cam guides located on side surfaces of the cams, each of the cam guides having a guide recess for slidably coupling and configured to guide the interval between the driving link and the driven link to change by selectively folding the connection links as a path of the cams varies, wherein each of the guide recesses includes:

a first recess portion formed parallel to the movable electrode;

a second recess portion formed at an end of the first recess portion at the movable electrode side, the second recess portion formed in an inclined shape towards the driven link-side end of the first recess portion; and a third recess portion formed at an end of the second recess portion at the movable electrode side, the third recess portion formed in an inclined shape towards the driving link-side end of the first recess portion.

2. The device of claim 1, wherein each of the plurality of connection links includes:

a first connection link rotatably coupled to an end of the driving link; and a second connection link having one end rotatably coupled to the first connection link and another end rotatably coupled to an end of the driven link.

3. The device of claim 2, wherein the cams are coupled to a connection part between the first connection link and the second connection link of each of the plurality of connection links.

4. The device of claim 1, further comprising protrusions formed among each of the first, second and third recess portions such that the cams smoothly move along each recess portion.

5. The device of claim 1, further comprising contact parts formed between each of the first recess portions and a corresponding second recess portion at a pre-arc start point or near the pre-arc start point, the pre-arc occurring between a fixed electrode and the movable electrode when the vacuum interrupter is closed.

6. The device of claim 1, further comprising contact parts formed between each of the second recess portions and a corresponding third recess portion at a contact time point between the movable electrode and a fixed electrode or at a time point after the contact time point.

7. The device of claim 1, further comprising a tensile elastic member located between the driving link and the driven link.

8. A vacuum breaker, comprising:

a vacuum interrupter including a movable electrode that is selectively detachable from a fixed electrode; and a power transmission device coupled to the movable electrode, the power transmission device including:

a driving link;

a driven link coupled to the movable electrode;

a first connection link connected to the driving link;

a second connection link connected to the driven link;

cams coupled between the first connection link and the second connection link; and cam guides located on side surfaces of the cams, each of the cam guides having a guide recess for slidably coupling corresponding cams and configured to guide movement of the cams, wherein each of the guide recesses includes:

a first recess portion formed parallel to the movable electrode;

a second recess portion formed at an end of the first recess portion at the movable electrode side, the second recess portion formed in an inclined shape towards the driven link-side end of the first recess portion; and a third recess portion formed at an end of the second recess portion at the movable electrode side, the third recess portion formed in an inclined shape towards the driving link-side end of the first recess portion.

9. The vacuum breaker of claim 8, further comprising protrusions formed among each of the first, second and third recess portions such that the cams smoothly move along each recess portion.

10. The vacuum breaker of claim 8, further comprising contact parts formed between each of the first recess portions and a corresponding second recess portion at a pre-arc start point or near the pre-arc start point, the pre-arc occurring between a fixed electrode and the movable electrode when the vacuum interrupter is closed.

11. The vacuum breaker of claim 8, further comprising contact parts formed between each of the second recess portions and a corresponding third recess portion at a contact time point between the movable electrode and a fixed electrode or at a time point after the contact time point.

12. The vacuum breaker of claim 8, further comprising a tensile elastic member located between the driving link and the driven link.

* * * * *